United States Patent [19]

Laveyne et al.

[11] Patent Number: 4,557,908

[45] Date of Patent: Dec. 10, 1985

[54] PROCESS FOR THE TREATMENT OF A PURGE SOLUTION PARTICULARLY INTENDED FOR A PROCESS FOR THE EXTRACTION OF ZINC BY ELECTROLYSIS

[75] Inventors: Michel Laveyne, Trappes; Claude Palvadeau, Breuillet, both of France

[73] Assignees: Minemet Recherche, Trappes, France; Preussag-Weser-Zink GmbH, Nordenham, Fed. Rep. of Germany

[21] Appl. No.: 603,267

[22] Filed: Apr. 24, 1984

[30] Foreign Application Priority Data

Apr. 25, 1983 [FR] France ..... 83 06805

[51] Int. Cl.[4] ..... C25C 1/16

[52] U.S. Cl. ..... 423/164; 204/119; 204/182.3

[58] Field of Search ..... 204/180 P, 119; 423/164

[56] References Cited

U.S. PATENT DOCUMENTS

| | | | |
|---|---|---|---|
| 3,357,823 | 12/1967 | Tuwiner | 75/135 |
| 4,030,989 | 6/1977 | Atmore et al. | 204/104 |
| 4,108,744 | 8/1978 | Bernat et al. | 204/119 |
| 4,171,250 | 10/1979 | Eddleman | 204/119 |

FOREIGN PATENT DOCUMENTS 2346457 10/1977 France .

*Primary Examiner*—R. L. Andrews

*Attorney, Agent, or Firm*—Fleit, Jacobson, Cohn & Price

[57] ABSTRACT

The invention relates to the treatment of purge solutions formed in the process of the extraction of zinc by electrolysis.

According to the invention, the purge solution, which consists of a part of the purified solution rich in zinc sulfate, is subjected to electrodialysis in the presence of an anion exchange membrane so that a catholyte is formed which is depleted in zinc and in sulfate and which contains magnesium. The catholyte can then be precipitated by neutralization, after recovery of the remaining zinc.

Application to the extraction of zinc from its ores.

15 Claims, 4 Drawing Figures

PROCESS FOR THE TREATMENT OF A PURGE SOLUTION PARTICULARLY INTENDED FOR A PROCESS FOR THE EXTRACTION OF ZINC BY ELECTROLYSIS

BACKGROUND OF THE INVENTION

The present invention relates to a process for the treatment of a purge solution making use of a process for electro-extraction of a recoverable metal, such as zinc associated with a process for membrane electrolysis.

This process of electrolytic treatment, the aim of which is to produce a purge solution depleted in zinc and in sulfuric acid, will hereafter be called extraction by electro-electrodialysis.

The invention also relates to a process for mounting an ion exchange membrane.

The manufacture of zinc by a hydrometallurgical and electrolytic route comprises a final operation of processing by electrolysis of solutions obtained by sulfuric leaching of roasted sulfide ores. Some of the impurities in the ores pass into solution during the leaching and more or less completely escape the purification process which precedes the electrolysis. Consequently, the impurities which are not deposited at the electrodes tend to concentrate in the electrolyte. When their concentration becomes too high, the solubility of zinc sulfate decreases and they tend to disturb the course of the electrolytic process. It is therefore necessary to carry out a "purge" of a fraction of the electrolyte. These purges cause major losses of zinc and sulfuric acid and in addition they have the disadvantage of being highly polluting.

The invention relates to a special treatment of a purge solution which has been withdrawn from an individual stage of the extraction process.

Understanding of the essential characteristics of the invention requires first of all knowledge of the usual processes employed in the technology. FIG. 1 is an outline diagram illustrating an example taken from the conventional processes for extraction of zinc by electrolysis. Reference 10 indicates the roasted sulfide ores forming the essential raw material. These ores undergo a leaching 12 intended to solubilize the zinc to the maximum and to retard the dissolution of the impurities as much as is possible. In general, the leaching comprises three operations: a "neutral" leaching operation 12*a*, an "acid" leaching operation 12*b* and an iron precipitation operation 12*c*. In practice, the solution obtained after acid leaching and precipitation or iron is subjected to neutral leaching. The raw leachate solution formed by this neutral leaching, indicated by the reference 14, arrives at the purification operations marked by the general reference 16. These operations are intended for the practically complete precipitation of the impurities which can be dangerous for the electrolysis, in particular, of copper, cadmium, nickel, cobalt, and the like. The solution 18 which is formed is a purified solution rich in zinc sulfate. This solution is then subjected to electrolysis 20. For example, the solution undergoes several electrolyses in cascade as shown by the references 20*a* and 20*b*. The zinc is deposited on the cathodes and the depleted solution 22 which has undergone electrolysis contains a large quantity of sulfuric acid and it is reused for leaching the ores 10. It will therefore be noted that the processing is carried out in a closed loop, with the result that the impurities which do not disappear during the purification 16, during the electrolysis 20, or during the precipitation of the residues (12*b*, 12*c*) accumulate and can attain very high values.

These leachate residues contain the iron entering the ore in various forms depending on the extraction process employed. The iron can be insolubilized in the form of goethite, hematite or jarosite. In the case of jarosite, we find, in association with the iron, alkaline elements ($Na^+$, $K^+$ and $NH_4^+$), sulfate ions ($SO_4^{2-}$) and water. This method of removal can be more advantageous for making use of the extraction by electro-electrodialysis.

The rates of purging allowing the level of residual impurities to be maintained below permissible limiting concentrations will thus be determined. The main impurity, and the one which determines the rate of purging of the plant is generally magnesium, since the great majority of zinc ores contain magnesium. The use of electrolytic extraction of zinc begins to pose problems when the concentration of magnesium exceeds 15 to 20 grams per liter. The problem posed by the magnesium grows when the concentrates employed as raw materials are of the dolomite type.

Another impurity whose accumulation is liable to pose some problems is manganese. The presence of this element is necessary, but it also must not exceed a specified concentration. The halogens, particularly fluorine and chlorine, can also accumulate in the electrolyte and become a nuisance for the electrolysis of zinc sulfate. However, since it is magnesium which most frequently determines the rate of purging of a plant for the extraction of zinc by electrolysis, the invention is described with reference to the separation of magnesium. However, those skilled in the art will easily be able to note that it also applies to the other impurities which can accumulate.

The purge solution may be withdrawn at one or more different locations in the operation of the process. For example, the purge 24 can correspond to a withdrawal of the raw leachate solution which is rich in zinc sulfate. As shown by reference 26, the purge can refer to a part of the purified solution rich in zinc sulfate. The purge can also be carried out during electrolysis, between several treatment stages as shown by reference 28. However, most frequently, the purge applies to the solution depleted in zinc sulfate which has just undergone electrolysis, as shown by reference 30. It may be considered that this purge of the depleted solution is the most judicious because it is the solution which contains the least zinc which constitutes the useful product. Nevertheless, this solution is highly acidic and requires the use of a large quantity of neutralizing agents.

The processes which are generally employed in the technology for the treatment of purges are, on the one hand, a neutralization-precipitation process and, on the other hand, a process of preliminary leaching of the concentrates. The neutralization-precipitation may sometimes be preceded by an electrolytic extraction of the solution.

In some rare cases, the purge solution 30 can be marketed directly. For example, the neutral purified solution of zinc sulfate can sometimes be employed directly for the production of zinc salts or of lithopone. Similarly, products obtained by straightforward evaporation of the solutions can sometimes be sold. However, these are relatively rare cases, taking account of the small market for such products.

All these solutions, however, are tied to an external market or to a particular environment of the zinc electrolysis plants and are subject to changes which can, in certain cases, affect the operation of the main process. One of the objectives of the present invention is to provide a purge treatment process which is integrated into the main scheme.

Unconventional treatments of the treatment of these purge solutions have also been tried. Reference can be made for example to the direct extraction of zinc by fixing on ion exchange resins or liquid-liquid extraction. Reference can also be made to the reversible fixing of sulfuric acid on ion exchange resins. However, the latter processes have not yet met with any real industrial success.

Attempts have also been made to treat the depleted solutions by dialysis and by electrodialysis. The dialysis process permits the formation of a moderately dilute acid which can be recycled, and of a low-acidity solution containing all the metallic cations. Operations of neutralization, solvent extraction, and the like, then permit a zinc extraction. The electrodialysis treatment permits the formation of recyclable sulfuric acid and the rejection of a magnesium-containing purge with low acidity which can be neutralized. These processes have not however met with commercial success.

SUMMARY OF THE INVENTION

The invention relates to a process for the extraction of a recoverable metal such as zinc, by electrolysis, applied, in the case of the electrolytic recovery of zinc, to a part of the stream of the purified solution rich in zinc sulfate the pH of which is advantageously between 2 and 5 and the zinc content advantageously between 100 and 150 grams per liter, a part of the flow which forms the purge.

In the following, the description of the invention will be restricted to the case of the treatment of purges in zinc plants.

The treatment of this solution comprises two principal steps:

- an extraction by electro-electrodialysis of the zinc sulfate solution. This is an electrolysis carried out in an electrolyzer with several compartments separated by an anionic membrane, that is to say an anion exchanger. This extraction can be carried out in a series of electrolyzers or in several series mounted in cascade.
- a neutralization of the purge solution depleted in zinc sulfate using conventional reagents such as lime, sodium hydroxide or sodium carbonate.

During this step, the manganese can undergo a specific treatment for oxidation into the form of manganese dioxide to separate it selectively from zinc and magnesium, the principal metals present in the purge solution.

Precipitation by neutralization is preferably done in stages in order to permit the recovery of the precious elements incorporated in the purge.

Without implying anything of a limiting nature in these explanations, it is appropriate to develop the theoretical points on which the present invention is based. This involves an electrolysis carried out in a cell where the catholyte and the anolyte are separated by an anion exchange membrane.

The metal to be recovered is deposited at the cathode. Nevertheless, it is not possible to exclude the presence of reactions which can be referred to as parasitic, which can be, for example, reduction of the proton to form hydrogen which is released. Under the effect of the applied electrical field, the anions, particularly sulfates, migrate from the catholyte toward the anolyte through the exchange membrane while, in principle, the cations do not cross the latter.

At the anode, the prevailing reaction is the oxidation of water; this gives rise to a release of oxygen and the production of protons, which makes it possible to recover the constituent elements of sulfuric acid. Furthermore, certain impurities, such as the manganese ion, can also lead to the formation of an $H^+$ ion during their oxidation, as shown by the following overall electrochemical equations:

$$H_2O \rightarrow O_2 + 2H^+ + 2e$$

$$Mn^{2+} + 2H_2O \rightarrow MnO_2 + 4H^+ + 2e$$

However, no anion exchange membrane is perfect; anion exchange membranes are characterized in particular by a lack of selectivity especially toward protons. The selectivity of the anion exchange membranes toward sulfate ions can be characterized by an apparent transport number of this ion in the membrane, defined as follows:

$$t_{SO_4^{--}} = I_{SO_4^{--}}$$

in which $I_{SO_4^{--}}$ is the intensity of the electric current carried by the sulfate ions in the membrane and $I_T$ the total electric current passing through the membrane.

During the research which led to the present invention it was found that this transport number depended particularly on the membrane, on the acidity of the anolyte and on the temperature according to the following experimental physical model:

$$t(SO_4^{--}) = A - B(H^+)_{anolyte}$$

where A and B are constants depending on the membrane, the environment in question and the temperature.

An anionic membrane tending toward ideal behavior would have its coefficient A tending toward 1 and its coefficient B tending toward 0. Experiment shows that the departure from this ideal behavior is due to the migration of protons from the anolyte toward the catholyte.

One of the inventive characteristics of the invention lies in the fact of counteracting, at least partially, the departure from ideal behavior of the membrane by regulating the acidity of the anolyte.

This regulation can be carried out by any appropriate means compatible with the remainder of the main electrolysis circuit. However, it has been found that it is particularly advantageous to regulate the acidity by determining a suitable flow of the solution which becomes the anolyte. This flow must be such that the acidity at the exit of the anode compartment is between 0.1N and 1N. When the present invention is applied to zinc electrolysis plants, all the substantially neutral solutions (below 0.1N) can meet the constraints specified above. Mention can be made, for example, of the electrolyte solutions known as neutral purified solutions, the solutions originating from filtrations and the various wash liquors before and after use. It is also possible to refer to solutions of ferrous sulfate which employ a different anode reaction, namely the oxidation of ferrous iron to ferric iron instead of and in the place of the oxidation of water.

Returning to one of the objectives of the present invention, which is to provide a purge which is as depleted in zinc and as low in acidity as possible, it is observed that the means described above, namely restriction of the transport of the $H^+$ ion from the anolyte toward the catholyte, is not sufficient to meet these two conditions completely. In fact, during the studies which led to the present patent application, it was shown experimentally that a particularly satisfactory feed corresponding to the conditions outlined above was the feeding of the cathode compartment with the neutral electrolyte solution referred to as purified, that is to say one of the possible feeds of the anolyte.

To obtain cathodes of a good quality it was possible to establish that the acidity in the cathode compartment should be maintained at a value above approximately 0.1N.

However, as mentioned earlier, it is desirable that the purge at the exit of the cathode compartment should be as low in acidity as possible. This involves therefore a compromise being made between the acidity constraints relating to the quality of the cathode deposit and those relating to the acidity of the purge; a good compromise consists in the choice of a catholyte acidity between 0.1 and 1N, preferably in the region of 0.6N.

Although it is technically possible to reduce the concentration of zinc to extremely low levels, of the order of 5 grams per liter or less, the technology to be employed and the consumption of energy are likely to make such a lowering of concentration prohibitive. It is preferable to employ conventional techniques and restrict, consequently, the concentration of zinc in the purge to 10 to 40 grams per liter, in any event, in a first step of electrolysis.

The feed flow of the cathode compartment is determined by the quantity of impurities to be purged. Given the relative constraints with respect to the acidity of the catholyte, described above, the feed flow of the anolyte can be determined. It was verified by experiment that the flow ratio between the anolyte and the catholyte can vary from approximately 5 to 20. It was found that on the other hand there was a tendency toward formation of concentration gradients and on the other hand a rise in temperature. These various problems can be solved by recycling the anolyte and the catholyte in a system of heat removal which can advantageously be an air cooler or an evaporator.

The recirculation of the electrolytes—anolyte or catholyte—in air cooling towers, which are generally employed in zinc electrolysis plants, is suitable for controlling the temperature of the solutions at values below or equal to 40° C.

Temperature regulation can also be carried out exclusively on the catholyte. Under these conditions, the extraction by electro-electrodialysis of zinc sulfate solutions takes place with a positive temperature gradient between the anolyte and the catholyte. This temperature difference, made possible by the use of a membrane, can reach 20° to 30° C., with a maximum temperature of the anolyte of 60° to 70° C. and the catholyte of 40° C.

These novel operating conditions also form one of the inventive characteristics of the present invention. They contribute to reducing the cell voltage and they improve the selectivity of the anion membrane. That is to say that for a given flow of purge solution and a given catholyte composition, a much lower flow of electrolysis anolyte is needed. Examples 3 and 4 illustrate perfectly this method of operation and the beneficial effect of the temperature.

The accepted evaporation during the cooling of the catholyte and a phenomenon of electro-osmosis which is found and recalled hereafter make it possible to obtain a purge flow, after extraction by electro-electrodialysis, which is much lower than the feed flow of the cathode compartment. This makes it possible to minimize the reject flow and the quantities of zinc and associated sulfate to be recycled, without having to alter the zinc contents of the effluent solutions. This favorable effect also increases the degree of recovery of zinc in a metallic form.

In order to satisfy certain legislation in force and for reasons of an economic nature, the treatment of the catholyte depleted in zinc sulfate must incorporate a zinc removal and/or recovery stage. This removal and/or recovery can be produced, for example, by selective precipitation by means of a base. This base can be chosen, for example, from the group formed by the alkaline hydroxides and carbonates. The low acidity of the depleted catholyte permits a saving of base and makes it possible to envisage the use of ion exchange compounds in the form of resin or in liquid form.

After a settling step, the zinc-bearing precipitate is separated from the mother liquors and can be recycled to the zinc extraction process, more precisely to the leaching operation. It is furthermore advantageous that the supernatent from the settling undergoes a neutralization, by means of suitable bases, so as to remove the impurities which determine the reject. This precipitation can be carried out in two steps so as to separate the magnesium from the manganese when present in the effluent. To do this, those skilled in the art will be able to employ any already known techniques, particularly that consisting in carrying out a precipitation which is both basic and oxidizing with respect to manganese.

In a more detailed manner, according to local conditions, those skilled in the art have available to them numerous possibilities for treating the zinc-depleted solution originating from the cathode compartment.

According to a first embodiment, it is possible to precipitate abruptly using sodium hydroxide or lime all of the metals present in this spent catholyte. When lime is employed, this water is substantially pure and can therefore be disposed of or recycled. After neutralization by means of sodium hydroxide, a solution of sodium sulfate is obtained which can be employed in the jarosite precipitation step when the zinc plant includes one.

According to a second embodiment, the depleted catholyte is subjected to oxidation with a strong oxide such as ozone, persulfate or chlorine dioxide and a base which may be weak, to precipitate manganese dioxide. This manganese dioxide can be usefully recycled in the main circuit since the latter employs manganese dioxide. Once the manganese has been removed, the zinc can be precipitated at a controlled pH using techniques which are well-known to those skilled in the art, to give a zinc hydroxide and/or a basic zinc sulfate. The precipitate may be employed and recycled in the main circuit. It may also be employed for the precipitation of manganese dioxide. The solution thus freed from manganese and zinc is then neutralized to precipitate the magnesium. In this step it is possible to employ either sodium hydroxide, which permits the last traces of magnesium to be removed, or lime which permits a less complete but less costly precipitation. When lime is employed the magnesium can be precipitated completely in two steps, the second step being carried out with a stronger base than lime, for example sodium hydroxide.

The invention also relates to a process for electrolytic extraction of zinc, of the type which comprises:

- the leaching of roasted sulfide ores with formation of a raw leachate solution rich in zinc sulfate;
- the purification of the raw leachate solution with formation of a purified rich solution;
- the electrolysis of the purified rich solution, with formation of zinc which is deposited at the cathode and a solution depleted in zinc sulfate;
- the recycling of the solution depleted in zinc sulfate to the leaching operation, and
- the purging of a part of at least one of the solutions in order that the concentration of impurities such as magnesium, which are in practice not separated in the operations of purification and electrolysis, does not exceed a predetermined threshold.

According to the invention, the purging is carried out by separating a part of the purified rich solution, and the process comprises in addition the treatment of this purge solution by the process of treatment referred to earlier, the anolyte formed during the treatment being directed toward the zinc recovery process.

Although according to the invention it is possible to employ a homogeneous membrane equally as well as a heterogeneous membrane, a membrane of the latter type may be preferable, owing to its better mechanical strength. This is the reason why the invention also relates to a process for fixing a heterogeneous membrane with selective permeability, comprising a substrate and a coating. This process comprises the moistening of the membrane, its application against a seal forming a closed loop, drying of the part of the membrane which is outside the seal bounding the closed loop while the part placed inside remains moist, stripping bare the substrate of the membrane in the dried part of the latter, and glueing this dry part to a support.

Both homogeneous and heterogeneous membranes can also be fixed to a frame using the technique which is known to the filter-press expert or by wedging the membrane between a frame equipped with a groove and a closed elastic seal forced into the groove so as to wedge the membrane between the groove and the elastic seal. The groove is preferably in the shape of a dovetail.

The treatment according to the invention offers many advantages. Firstly, the losses of sulfuric acid are very small because the solution which is actually purged originates from the catholyte of the electrodialysis, and this catholyte is highly depleted in sulfate ions since the membrane is of an anionic type.

Next, the low acidity of the catholyte facilitates the recovery of the residual zinc.

The zinc is recovered at the cathode in an extremely pure form.

Overall, the transport of ions in the anion membrane causes an electro-osmotic flow of the catholyte toward the anolyte. Consequently, the volume of the catholyte to be treated is therefore reduced.

It is found that the life of the anodes is very long. Moreover, this treatment is very clean and can be easily integrated into an existing electrolysis system.

Finally, the operating conditions are markedly better than those of the conventional electrolysis processes owing to the low acidity of the electrolytes.

Other characteristics and advantages of the invention will appear more clearly from the detailed description, which will follow, of an example of embodiment, given purely as an illustration, with reference to the attached drawings in which, FIG. 1 having already been described:

DESCRIPTION OF THE PREFERRED EMBODIMENTS

Figure 1:
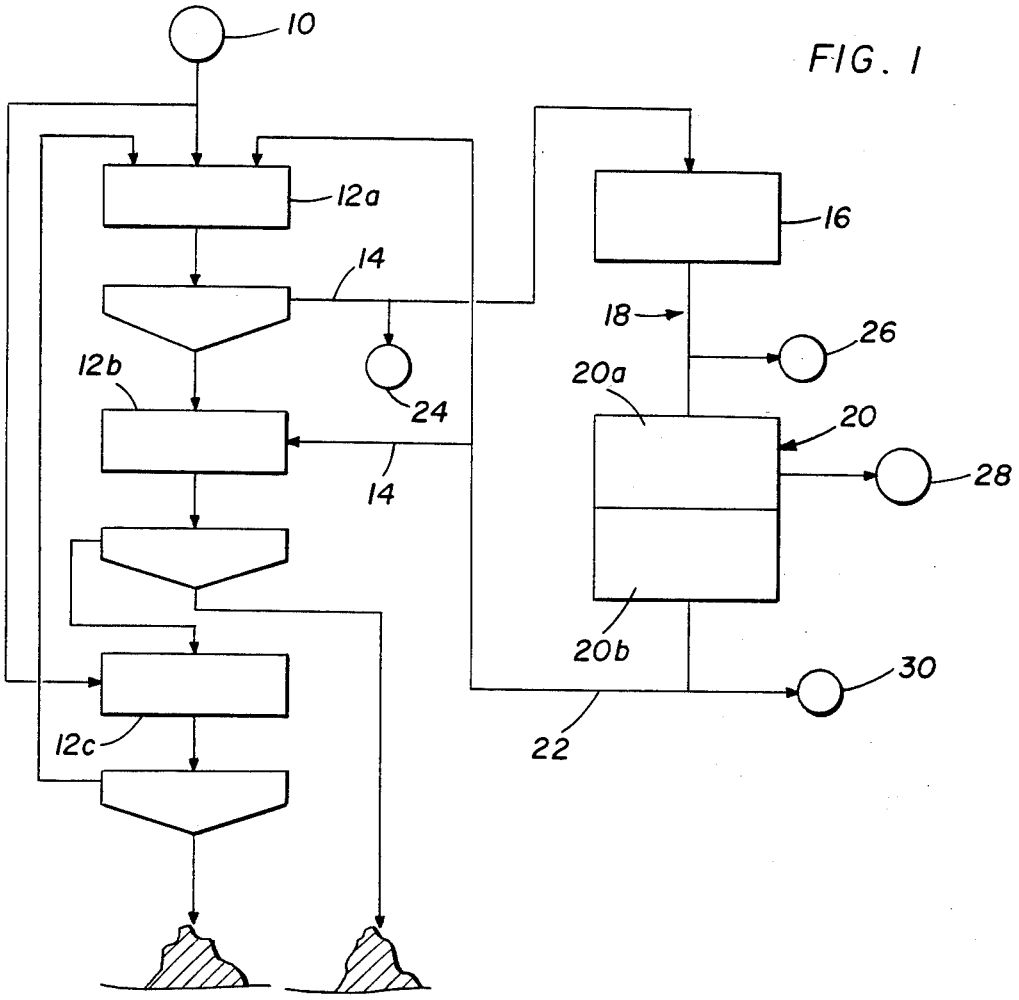
Figure 2:
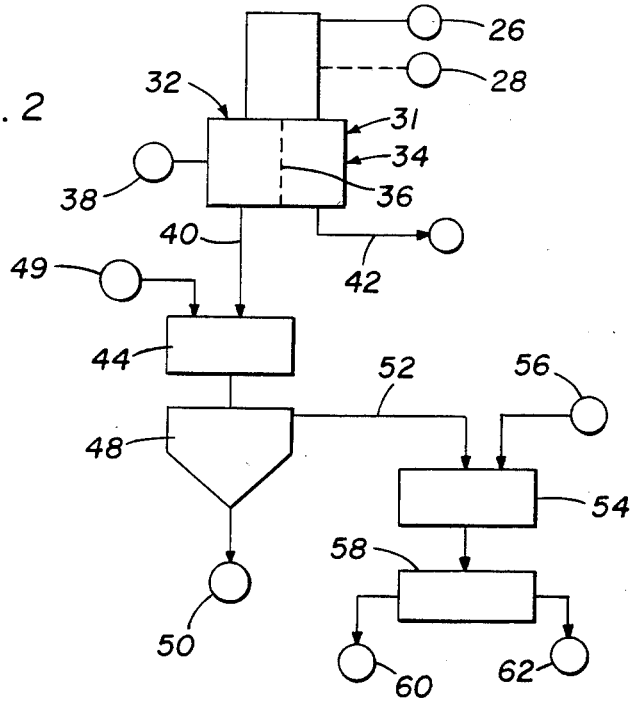
FIG. 2 is a general diagram illustrating the utilization of the process of treatment according to the invention.

FIG. 2 shows the main operations of the treatment according to the invention. The purified solution rich in zinc sulfate 26 is transported to the electrodialysis cell 31 which has a catholyte compartment 32 and an anolyte compartment 34 which are separated by an anionic membrane 36.

In the catholyte compartment, zinc is deposited on the cathode, as shown by reference 38, and a catholyte depleted in zinc can be withdrawn as shown by reference 40. In the anolyte compartment, the sulfate ions are concentrated because they enter this compartment from the catholyte compartment. The solution 42 withdrawn from this compartment, rich in acid, can be returned directly to the electrolysis of the zinc extraction process.

The depleted catholyte 40 is then subjected to a neutralization 44 with lime, to a pH of the order of 5.5. The zinc precipitates in the form of basic sulfate. A settling 48 permits the separation of heavy products 50 containing the basic salt from a liquid effluent 52 which contains the manganese and the magnesium.

The liquid effluent 52 is then subjected to a new neutralization 54 with lime 56, to a pH of the order of 9 to 12. The treatment of the materials formed 58 permits the separation of solid materials 60 containing manganese and magnesium hydroxides and calcium sulfate from a liquid effluent 62, which may be recycled upstream of the leaching of the roasted sulfide ores, as simply discharged after a readjustment of the pH to 8.

Since the heavy zinc-bearing products 50 are recycled to the leaching operation 12, which the anolyte 42 is returned to the electrolysis operation, the only products withdrawn are, on the one hand, zinc 38 and, on the other hand, the solid materials 60 and in certain cases the liquid effluent 62.

Figure 3:
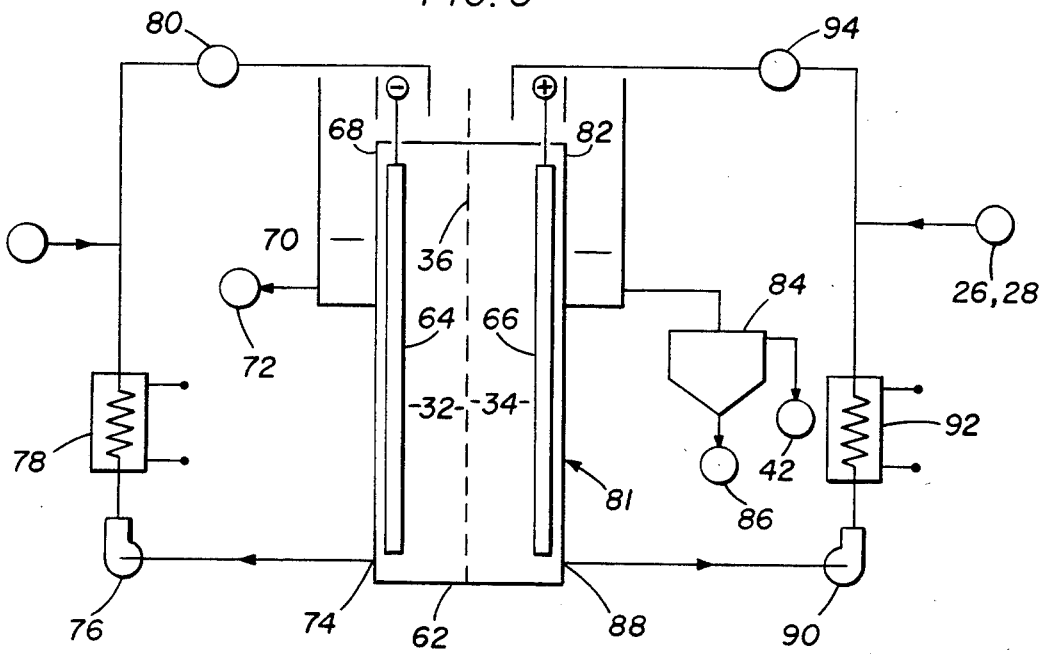
FIG. 3 is a diagrammatic cross-section of an electrodialysis cell suitable for the use of the treatment according to the invention.

Before describing the conditions for making use of this treatment, it is appropriate to study in more detail an example of a cell of a membrane electrolyzer which may be employed for this purpose, with reference to FIG. 3.

More precisely, the electrolysis cell of FIG. 3 has catholyte and anolyte compartments 32 and 34 respectively, separated by the anionic membrane 36. The cell has a vessel 62 which contains a cathode 64 and an anode 66. The cathode 64 is advantageously made of aluminum, and the anode 66 of lead or a lead-silver alloy. The excess catholyte, corresponding to the quantity of purified solution 26 introduced into the circulation loop, passes over a spillway 68 into a receiver 70 before being discharged as shown by reference 72, in the form of depleted catholyte.

The catholyte circulates in the cell. A part of it is removed at 74, at the bottom of the cell, and a pump 76 circulates it in a heat exchanger 78 which maintains it, for example, at 40° C., allowing for possible indirect losses, and in an apparatus 80 for measuring the pH.

On the anolyte side, the excess overflows by a spillway 82 and reaches a settler 84 in which $MnO_2$ which may have precipitated can be separated as shown by reference 86. The liquid effluent forms the enriched solution 42 conveyed to the electrolysis. The anolyte also advantageously circulates and it is partly removed by an outlet 88 formed in the bottom of the vessel, by a pump 90 which circulates it in a heat exchanger 92 which maintains it between 40° C. and 70° C., and then in an apparatus 94 for measuring the pH.

In an advantageous embodiment, the distance separating the cathode from the membrane is 40 millimeters, and the distance separating the anode from the membrane is 20 millimeters. The anolyte is preferably introduced transversely to the electrodes while the catholyte is fed from above. Furthermore, the permeability of the membranes is virtually nil, with the result that the catholyte may have a level higher than that of the anolyte; in this way, the catholyte, whose density is lower than that of the anolyte, can overflow while the differential hydrostatic pressures applied to the membrane are balanced.

The purified solution which is employed for the purge contains generally a high concentration of zinc, which is often of the order of 150 grams per liter. Magnesium is present at a concentration of approximately 15 grams per liter and manganese in a concentration of approximately 7.5 grams per liter. Its pH is of the order of 5.

When the acidified anolyte originates from the purified neutral solution, it also contains approximately 150 grams of zinc per liter but the catholyte contains only 5 to 40 grams of it per liter. In fact, this low concentration is due to the deposition of zinc on the cathode. The quantity of solution introduced is controlled so that the concentration of zinc remains at this level during the treatment. The acid is present in the electrolyte at a concentration of 0.1 to 0.6N.

It is advantageous that the current density should be of the order of 200 to 800 amperes per square meter, preferably 400 amperes per square meter.

It is desirable however that this acidity should be at least 0.6N because, when it is less than 0.3N, the zinc deposits which are formed can be friable and dendritic. Similarly, it is desirable that their current density and the temperature of the catholyte should not exceed the values of approximately 800 amperes per square meter and 50° C. respectively when the zinc deposits formed need to be smooth and not very fragile.

The faradic efficiency of the reaction is most frequently between 0.75 and 0.98, and it is preferable that the concentration of zinc should be near the top of the range indicated, that is to say in the region of 40 grams per liter, because the faradic efficiency is then in the upper part of the range indicated, at 0.95 and even higher.

Commercial anion exchange membranes are suitable for making use of the process, but the use of the heterogeneous membrane sold under the tradename IONAC A3475 by IONAC CHEMICAL COMPANY is preferable. In fact, this membrane lends itself very well to fixing by glueing to a frame, advantageously made of plastic. This method of mounting according to the invention comprises firstly the moistening of the whole membrane and then, while it is still moist, its application between a seal forming a closed buckle. The part of the membrane outside the seal bounding the closed loop is then dried, the part placed inside the seal being maintained in a moist state. As soon as the outer part is dry, it is stripped bare at the periphery of its active coating to reveal the woven substrate, generally made of polypropylene or polyvinyl chloride, which is glued to the plastic frame.

The treatment according to the invention then comprises the neutralization of the depleted catholyte formed by electro-electrodialysis. This reaction, carried out at a pH of the order of 5.5, causes the precipitation of the zinc according to the reactions:

$$H_2SO_4 + CaO\ CaSO_4 + H_2O$$

$$7ZnSO_4 + 6CaO + 10H_2O\ 6Zn(OH)_2ZnSO_4, 4H_2O + 6CaSO_4$$

The settling permits the separation of the basic zinc sulfate and of gypsum, which are returned to the leaching operation. The gypsum is then removed with the leaching residues.

The liquid effluent from the settling is then subjected to a more extensive neutralization to a pH of 9 to 10 in order that manganese and magnesium may precipitate, according to the reactions:

$$MnSO_4 + CaO \xrightarrow{H_2O} Mn(OH)_2 + CaSO_4$$

$$MgSO_4 + CaO \xrightarrow{H_2O} Mg(OH)_2 + CaSO_4$$

These neutralization operations are of a conventional type and those skilled in the art know how to carry them out. They are therefore not described in detail.

The use of sodium-containing basic agents ($Na_2CO_3$ or NaOH) while permitting a precipitation of the zinc separately from that of the manganese and of the magnesium, results in the production of a final liquid effluent consisting of sodium sulfate.

This effluent lends itself well to recycling to the iron precipitation stage in the processes employing the route with jarosite as the waste iron carrier.

The non-limiting examples which follow are intended to put the experts in a position to determine easily the operating conditions which should be employed in each particular case.

EXAMPLE 1

With the aid of the laboratory device described earlier and illustrated in FIG. 3, several applications of the process of extraction of electro-electrodialysis of zinc sulfate solution have been carried out. The composition of the electrolytes is fixedly mainly by that of the purified neutral solution, by its feed flow (Da) in the anode compartment of the electrolyzer and by the ratio of the latter to the flow of neutral solution introduced into the cathode compartment (Dc).

The results listed in Table 1 below are given by way of a demonstration. They were obtained in a laboratory cell in which the surface area of the electrodes employed was 1 square decimeter, the average current density 400 amperes per square meter and the temperature of the electrodes 40° C. The flows D'a and D'c are respectively the effluent flows of the anode or cathode compartment. To improve further the quality of the zinc deposits, the neutral solution fed into the catholyte contained 50 milligrams per liter of bone glue.

TABLE No. 1

Examples of operation of electrodialysis

| Operating parameters | | | | Anolyte | Catholyte | | | |
|---|---|---|---|---|---|---|---|---|
| Da l/h | Dc l/h | Da Dc | I A | $H_2SO_4$ N | $H_2SO_4$ N | Zn g/l | D'c l/h | Faradic efficiency |
| 0.18 | 0.039 | 4.6 | 5.27 | 0.88 | 0.32 | 13 | 0.031 | 78 |
| 0.38 | 0.047 | 8.3 | " | 0.44 | 0.44 | 22 | 0.037 | 89 |
| 0.44 | 0.056 | 7.8 | " | 0.40 | 0.38 | 37 | 0.044 | 93 |
| 0.22 | 0.044 | 5.0 | " | 0.71 | 0.43 | 17 | 0.034 | 85 |
| 0.26 | 0.043 | 6.0 | " | 0.72 | 0.40 | 17 | 0.047 | 84 |

EXAMPLE NO. 2

Extraction of the zinc sulfate solution in a cascade of membrane electrolyzers

Figure 4:
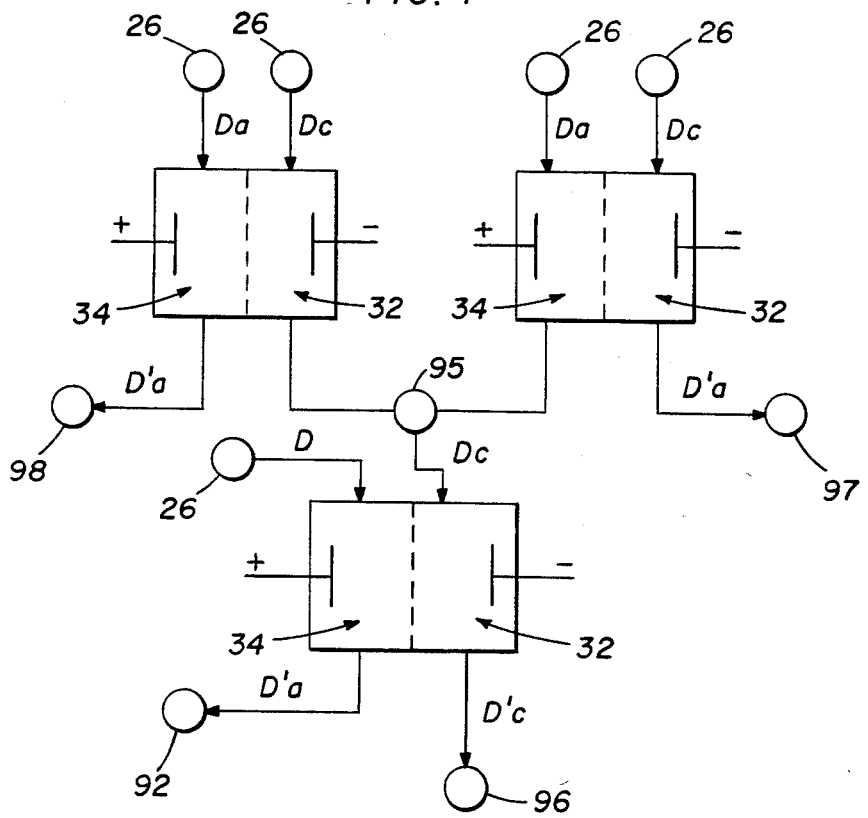
FIG. 4 is a general diagram illustrating the use of the process in two stages for depleting the solution or better the solution with respect to $ZnSO_4$ and $H_2SO_4$ according to the invention.

The general diagram of this particular arrangement is shown in FIG. 4. The anode compartments 34 of the various electrolyzers and the cathode compartments of the cells of the first series are fed with the purified neutral solution 26.

The depleted catholyte 95 leaving the cells of this series is fed by the cathode circuit 32 of the second series of electrolyzers. The advantage of such an organization of the electrolysis cells resides in the possibility of extracting the purge solutions with respect to zinc sulfate as well as possible, while minimizing the consumption of electrical energy required for the treatment. The anolytes withdrawn from each series of cells 98 and 97 are conveyed to the electrolysis of the main process.

In Table No. 2 below an example is given of operation of a cascade of two cells consisting of a central cathode compartment and two outer anode compartments. The useful surface area of the electrode of each cell is 0.275 square meters and the purified neutral solution 26 consists of:

Zn: 136 grams per liter
Mn: 7 grams per liter
Mg: 16 grams per liter
$H_2SO_4$: 0.1N.

TABLE 2

Examples of operation of a cascade of two electrolyzers

| Electrolyzer | Surface area of the cathodes | J HXM—$^2$ | Da l/h | Dc l/h | D'c l/h | Cell voltage V | F % | Composition of the electrolytes (g/l) Anolyte Zn | Anolyte Mn | Anolyte Mg | Anolyte $H_2SO_4$ | Catholyte Zn | Catholyte Mn | Catholyte Mg | Catholyte $H_2SO_4$ |
|---|---|---|---|---|---|---|---|---|---|---|---|---|---|---|---|
| 1 | 0.275 | 400 | 6.30 | 1.23 | 0.98 | 7.6 | 95 | 132 | 7 | 16 | 25 | 40 | 8.7 | 20 | 30 |
| 2 | 0.275 | 400 | 6.24 | 2.70 | 2.4 | 7.6 | 68 | 132 | 7 | 16 | 30 | 8 | 10 | 25 | 20 |

EXAMPLE 3

A workshop for trials on a large laboratory scale was constructed in a zinc electrolysis plant.

The trial installation consisted of three cells, each cell with a cathode with 0.275 $m^2$ of active surface area, a cathode diaphragm case and two Pb/Ag anodes.

The production of cathode zinc per cell was 3.1 kilograms per day.

Without implying a limiting nature, the cells were fed with:

1.20 liters per hour of purified $ZnSO_4$ solution at a pH of approximately 4 for the cathode compartment of the cell 9.0 liters per hour of purified $ZnSO_4$ solution at a pH of approximately 4 for the anode compartment of the cell.

The current intensity was 110 amperes per hour.

The temperature was 38° C. in the cathode and anode compartments.

With the feed rates mentioned above, the following results were obtained:

| | Catholyte | Anolyte |
|---|---|---|
| Anolysis $H_2SO_4$ (N) | 0.40 | 0.40 |
| Zn (S/C) | 40 | 139 |

The outlet flow of the catholyte was 0.98 liter per hour. The faradic efficiency was 98%, the voltage at the cell terminals 6.25 volts.

The zinc deposits were compact and easy to detach from the supporting cathode. The content of lead in the zinc was below 10 grams per tonne.

Even after nine months of uninterrupted operation with the same exchanger cloths and using the same feed flows in the cathode and anode compartments, it was not possible to detect changes in the concentrations of free acidity and of the voltage.

EXAMPLE 4

The same installation as that mentioned in Example 3 was employed for operating with higher temperatures in the anode compartment of the cell.

Without implying a limiting nature, the cells were fed with:

1.20 liters per hour of purified $ZnSO_4$ solution at a pH of approximately 4 for the cathode compartment of the cell 3.0 liters per hour of purified $ZnSO_4$ solution at a pH of approximately 4 for the anode compartment of the cell.

The temperature in the cathode compartment was 42° C. The temperature in the anode compartment was 62° C.

With the feed flows and temperatures mentioned above, the following results were obtained:

| | Catholyte | Anolyte |
|---|---|---|
| Analysis $H_2SO_4$ (N) | 0.55 | 1.12 |

-continued

| | Catholyte | Anolyte |
|---|---|---|
| Zn (S/C) | 41 | 138 |

The outlet flow of the catholyte was 0.94 liter per hour. The faradic efficiency was 98%, the voltage at the cell terminals 5.2 volts.

The zinc deposits were compact and easy to detach from the supporting cathode. The content of lead in the zinc was below 10 grams per tonne.

EXAMPLE 5

The same installation as that mentioned in Examples 3 and 4 was employed to operate with higher temperatures in the anode compartment of the cell and a water feed to the anode compartment instead of the purified zinc sulfate solution.

Without implying a limiting nature, the cells were fed with:

1. 20 liters per hour of purified $ZnSO_4$ solution at a pH of approximately 4 for the cathode compartment of the cell
2. 4 liters per hour of water for the anode compartment of the cell.

The temperature in the cathode compartment was 42° C. The temperature in the anode compartment was 62° C.

With the feed flows and temperatures mentioned above, the following results were obtained:

| | Catholyte | Anolyte |
|---|---|---|
| Analysis $H_2SO_4$ (N) | 1.24 | 1.15 |
| Zn (S/C) | 40 | — |

The outlet flow of the catholyte was 0.9 liter per hour. The faradic efficiency was 95%, the voltage at the cell terminals 3.8 volts.

The zinc deposits were compact and easy to detach from the supporting cathode. The content of lead in the zinc was below 10 grams per tonne.

What is claimed is:

1. A method of producing a purge solution during the electrolytic recovery of metal from an aqueous solution containing a high concentration of a recoverable metal salt, said process comprising the steps of:

feeding a catholyte comprising said aqueous solution containing the recoverable metal salt to a cathode compartment of an electrolysis cell, said cathode compartment containing a cathode;

feeding an anolyte comprising said aqueous solution containing the recoverable metal salt to an anode compartment of said electrolysis cell, said anode compartment containing an anode, said cathode compartment and said anode compartment being separated by an anion exchange membrane;

causing said recoverable metal to be deposited on the cathode of said electrolysis cell by electrolysis;

causing said anions to migrate from said catholyte through said anion exchange membrane to said anolyte by electrodialysis; and adjusting the flow rate of said anolyte through the anode compartment in such a manner that the acid concentration in said anolyte remains below 0.5N to increase the efficiency of said anion exchange membrane.

2. A process according to claim 1, which further comprises controlling the temperature of the catholyte.

3. A process according to claim 2, which further comprises controlling the temperature of the anolyte.

4. A process according to claim 1, which further comprises recycling anolyte exiting said anode compartment back to said anode compartment.

5. A process according to claim 1, which further comprises treating the catholyte after extraction of said recoverable metal to remove residual recoverable metal therefrom.

6. A process according to claim 1 wherein the said recoverable metal is zinc and said aqueous solution of the recoverable metal salt is a purified solution of zinc sulfate having a pH of greater than 1.5.

7. A process according to claim 6, wherein the electrolytic recovery of metal from said aqueous solution is carried out in a plurality of electrolyzers.

8. A process according to claim 7, wherein the process for treating the catholyte comprises neutralizing the catholyte exiting the plurality of electrolyzers with a base to separate the catholyte into a basic zinc salt and a liquid effluent.

9. A process according to claim 8, in which said catholyte contains magnesium and manganese and which further comprises:

neutralizing said liquid effluent to a pH of approximately 11; and separating a precipitate containing the magnesium and the manganese formed during the neutralization of said liquid effluent.

10. A process according to claim 8, in which said catholyte contains manganese and which further comprises:

selectively precipitating manganese after oxidation to manganese dioxide;

separating said manganese dioxide, and neutralizing said liquid effluent with sodium hydroxide to a pH of approximately 11 to remove the magnesium.

11. A process according to claim 6 wherein, after electrolysis, the catholyte has a zinc sulfate concentration which is much lower than the zinc sulfate concentration of said aqueous solution.

12. A process according to claim 1 which further comprises separately circulating the anolyte and the catholyte in closed circuits.

13. A process according to claim 6, which further comprises recycling a portion of the anolyte exiting said anode compartment.

14. A process for the electrolytic recovery of zinc which comprises the steps of:

leaching roasted sulfide ores to form a raw leachate solution which is rich in zinc sulfate;

purifying said raw leachate solution to form a purge solution which is rich in zinc sulfate;

adding said purge solution to a cathode compartment of an electrolysis cell to form a catholyte solution, said cathode compartment containing a cathode;

adding said purge solution to an anode compartment of an electrolysis cell to form an anolyte solution, said anode compartment containing an anode and said anode compartment and said cathode compartment being separated by an anion exchange membrane;

causing zinc to deposit at the cathode of said electrolysis cell by electrolysis to form a catholyte solution which is depleted in zinc sulfate;

causing anions to migrate from said catholyte solution through said anion exchange membrane to said anolyte by electrodialysis;

adjusting the flow rate of said anolyte solution through the anode compartment in such a manner that the acid concentration in said anolyte remains below 0.5N;

recycling a portion of said catholyte solution to said leaching step;

neutralizing a portion of said catholyte solution to remove unseparated impurities so that the concentration of unseparated impurities in said portion of said catholyte solution does not exceed a predetermined threshhold; and recycling a portion of the anolyte solution exiting said anode compartment back to the anode compartment of said electrolysis cell.

15. A process according to claim 14, wherein said purge solution is conveyed partly to a catholyte compartment and partly to an anolyte compartment, and the part conveyed to the catholyte compartment is mixed with a part of said catholyte depleted in zinc sulfate.

* * * * *